US008084944B2

(12) United States Patent
Berndanner et al.

(10) Patent No.: US 8,084,944 B2
(45) Date of Patent: Dec. 27, 2011

(54) LAMP DEVICE AND METHOD FOR THE PRODUCTION OF A LAMP DEVICE

(75) Inventors: Stephan Berndanner, Yokohama (JP); Gerhard Löffler, Eichstätt (DE)

(73) Assignee: Osram AG, München (DE)

( * ) Notice: Subject to any disclaimer, the term of this patent is extended or adjusted under 35 U.S.C. 154(b) by 206 days.

(21) Appl. No.: 12/520,867

(22) PCT Filed: Dec. 22, 2006

(86) PCT No.: PCT/EP2006/070181

§ 371 (c)(1),
(2), (4) Date: Jun. 24, 2009

(87) PCT Pub. No.: WO2008/083700

PCT Pub. Date: Jul. 17, 2008

(65) Prior Publication Data

US 2010/0052530 A1 Mar. 4, 2010

(51) Int. Cl.
*H01J 17/18* (2006.01)
*H01J 9/00* (2006.01)

(52) U.S. Cl. ..... 313/623; 313/634; 445/26

(58) Field of Classification Search ..... 313/318.07, 313/623–626, 634; 445/23, 26, 38, 42
See application file for complete search history.

(56) References Cited

U.S. PATENT DOCUMENTS

| | | | |
|---|---|---|---|
| 2003/0057837 | A1 | 3/2003 | Davey |
| 2003/0151364 | A1 | 8/2003 | Matsushima et al. |
| 2004/0100196 | A1 | 5/2004 | Chiba |
| 2006/0170318 | A1 | 8/2006 | Morimoto et al. |

FOREIGN PATENT DOCUMENTS

| | | | |
|---|---|---|---|
| CN | 1445813 | A | 10/2003 |
| EP | 0913 855 | | 5/1999 |
| EP | 1 339 091 | A2 | 8/2003 |
| JP | 2001-126662 | | 5/2001 |

*Primary Examiner* — Bumsuk Won
(74) *Attorney, Agent, or Firm* — Cozen O'Connor

(57) ABSTRACT

A lamp device (1), wherein the lamp device (1) has at least one contact conductor (31) and a vessel (20) for enclosing a gas. The vessel (20) delimits a primary volume (40) and a secondary volume (41), the primary volume (40) and the secondary volume (41) being interconnected by a transitional region (21) of the vessel (20). The contact conductor (31) runs through the transitional region, and the contact conductor (31) has a recess (33) that is arranged in the transitional region.

24 Claims, 6 Drawing Sheets

LAMP DEVICE AND METHOD FOR THE PRODUCTION OF A LAMP DEVICE

RELATED APPLICATIONS

This is a U.S. national stage of application No. PCT/EP2006/070181, filed on Dec. 22, 2006.

FIELD OF THE INVENTION

The invention relates to a lamp device, in particular a lamp device for a discharge lamp, and a method for the production of a lamp device.

BACKROUND OF THE INVENTION

Discharge lamps generally have a discharge vessel that is filled with a useful gas, and in which radiation is generated by discharge of the useful gas. In the production of such discharge lamps, the discharge vessel is mostly pumped out before being filled with the useful gas, in order to remove the ambient gas, for example air, located in the discharge vessel. During operation of the discharge lamp, a significant residual quantity of the ambient gas remaining in the discharge vessel can cause deposits on the inner side of the discharge vessel and thus lead to an undesired blackening of the discharge vessel.

SUMMARY OF THE INVENTION

It is an object of the present invention to specify for a discharge lamp a lamp device in the case of which the above-named deposits are reduced during operation of the discharge lamp. Furthermore, a method for the improved production of a lamp device is to be specified.

This and other objects are attained in accordance with one aspect of the present invention directed to a lamp device that has a contact conductor and a vessel for enclosing a gas. The vessel delimits a primary volume and a secondary volume. The primary volume and the secondary volume are interconnected by a transitional region of the vessel. The contact conductor runs through the transitional region, and has a recess that is arranged in the transitional region.

The recess facilitates an exchange of gas between the primary volume and the secondary volume. During production of the lamp device, an ambient gas located in the vessel can be pumped out in an improved fashion. It is thereby advantageously possible to reduce a residual quantity, remaining in the vessel, of the ambient gas enclosed in the vessel during the production.

The recess in the contact conductor preferably extends from the primary volume into the secondary volume. It is also preferred to design the recess as a channel for the transfer of gas from the primary volume into the secondary volume and vice versa, that is to say from the secondary volume into the primary volume. The channel advantageously facilitates an exchange of gas between the primary volume and the secondary volume.

In a preferred embodiment, an electrode is formed on the contact conductor. The electrode is preferably arranged in the primary volume of the vessel. During operation of the lamp device, the electrode can bring about in the primary volume a gas discharge that serves to generate (preferably visible) radiation. The radiation thus generated can exit at least partially through the vessel, which is expediently transmissive at least for spectral sub-regions of this radiation. In particular, the radiation can exit from the vessel in a region thereof that delimits the primary volume.

In a further preferred refinement, the contact conductor runs through the secondary volume. Here, an end face bounding the contact conductor in a longitudinal direction on the side averted from the electrode expediently projects from the vessel. During operation of the lamp device, it is possible in this way to feed an electric voltage to the electrode via the contact conductor from outside the vessel in a simplified fashion.

The contact conductor and the electrode can be of unipartite design. Alternatively, the contact conductor and the electrode can be of multipartite design, the contact conductor and the electrode being interconnected in an electrically conducting and mechanically stable fashion.

The contact conductor is, furthermore, preferably of elongated design. For example, the contact conductor can be of rod-like design, for instance with a cross section embodied in circular fashion at least in some portions. The contact conductor and the electrode are expediently designed to be electrically conductive, preferably metallic. Furthermore, the contact conductor and the electrode have a sufficiently high mechanical stability and thermal loading capacity. The contact conductor and the electrode preferably contain a metal, with particular preference a metal with a comparatively high melting point, for example tungsten or molybdenum, or consist of such a metal or a metal alloy that contains such a metal.

In a preferred refinement, the electrode projects beyond the contact conductor in a fashion transverse to the longitudinal direction of the contact conductor. The electrode can be designed as an anode for a discharge lamp. The greater the cross-sectional surface area of the anode is designed to be, the higher the radiant powers that can be attained during operation of the lamp device.

In a further preferred refinement, an extent of the electrode perpendicular to the longitudinal direction of the contact conductor is greater than a minimum inside diameter of the vessel in the transitional region. In other words, the electrode is widened so greatly with reference to the contact conductor that the electrode cannot be guided through the transitional region, in particular even in the case of a rotation of the electrode by any desired angle about an axis running along the longitudinal direction of the contact conductor.

Starting from the transitional region, the vessel preferably widens along the longitudinal direction of the contact conductor both toward the primary volume of the vessel and toward the secondary volume of the vessel. The transitional region in this case constitutes a constricted region of the vessel. It follows that the inner cross-sectional surface area of the vessel is small in the transitional region by comparison with an inner cross-sectional surface area in the regions of the vessel that delimit the primary volume and the secondary volume respectively.

In a preferred refinement, the recess in the contact conductor is designed, with particular preference along the entire transitional region, in such a way that, perpendicular to the longitudinal direction of the contact conductor, an inner cross-sectional surface, area free from the contact conductor, of the transitional region is increased by at least 5%, with particular preference by at least 10%, for example by between 20% inclusive and 30% inclusive, by comparison with a corresponding arrangement without recess. The free inner cross-sectional surface area of the transitional region is in this case the surface that, in a cross section through the transitional region running perpendicular to the longitudinal direction of the contact conductor, is edged by the vessel and is not occupied by the contact conductor. Thus, the surface occupied in such a cross section by the contact conductor is reduced by means of the recess. Via the recess in the contact conductor, an exchange of gas can advantageously take place between the primary volume and the secondary volume in addition to a free space that can, for example, be designed like a gap between the contact conductor and an inner wall of the vessel in the transitional region.

The recess in the contact conductor is preferably locally delimited in a longitudinal direction of the contact conductor, and therefore extends only within a region that is bounded by two sectional planes running perpendicular to the longitudinal direction of the contact conductor. These sectional planes are respectively spaced apart from the end faces bounding the contact conductor in a longitudinal direction and/or from the electrode. In this case, one sectional plane runs through the primary volume and the other sectional plane runs through the secondary volume.

Alternatively, the recess can extend at least up to an end face of the contact conductor or up to the electrode. For example, the recess can be of fluted design, the recess extending between the end faces of the contact conductor or between an end face of the contact conductor and the electrode.

In a preferred development, the recess is formed in a surface of the contact conductor bounding the contact conductor transverse to the longitudinal direction of the contact conductor. The recess is designed with particular preference like a trough. The recess is thus bounded transverse to the longitudinal direction.

Alternatively, the recess can completely penetrate the contact conductor transverse to the longitudinal direction at least in some portions. By way of example, in this case the recess can be designed like a slot.

The size of the inner cross-sectional surface area free from the contact conductor can be set by the cross-sectional surface area of the recess, that is to say by the width and the depth of the recess. The width and the depth of the recess are expediently selected so as to avoid molten vessel material penetrating completely into the recess during production of the vessel. The recess preferably has a width and/or a depth of between 10 μm inclusive and 20 mm inclusive, with particular preference of between 50 μm inclusive and 5 mm inclusive.

In a preferred refinement, the contact conductor has an additional recess in the transitional region of the vessel. In this case, the additional recess can have the same or substantially the same properties as the recess. In the case of more than one recess, gas can be exchanged between the primary volume and the secondary volume by means of a number, corresponding to the number of the recesses, of mutually spaced apart channels. The cross-sectional surface area of the recesses can in each case be smaller here, in conjunction with an exchange of gas that is equally good or improved, than in the case of a single recess.

In a further preferred refinement, a further secondary volume is delimited by means of the vessel, the further secondary volume being connected to the primary volume by means of a further transitional region. It is furthermore preferred for a further contact conductor to run through the further transitional region, the further contact conductor having with particular preference a further recess in the further transitional region. The further contact conductor and/or the further recess in the further contact conductor likewise can have at least one of the features of the contact conductor and/or the features of the recess in the contact conductor respectively. In particular, the further contact conductor is preferably of elongated design. The longitudinal directions of the contact conductor and of the further contact conductor preferably run collinearly, the contact conductor and the further contact conductor projecting with particular preference into the primary volume from opposite sides.

It is furthermore preferred to form a further electrode preferentially on the further contact conductor. It is further preferred for the electrode and the further electrode to face one another. During operation of the lamp device, it is possible to apply between the electrode and the further electrode a voltage that can be applied from outside the vessel via the contact conductors, preferably from opposite sides.

In a further preferred refinement, a lamp comprises an inventive lamp device. Here, the lamp device is preferably fastened on at least one base part. By means of the base part, the lamp in a mount can be mounted and preferably, electrical contact can be made with the lamp, that is to say said lamp can be driven with the aid of an external electrical power source.

The lamp is preferably embodied as a discharge lamp. Here, the vessel of the lamp device is filled with a useful gas. The useful gas can, for example, contain a noble gas, for example xenon. Furthermore, the useful gas can contain an additional filler, in particular for setting the color locus of the radiation generated during operation of the lamp, for example a metal halide.

It is preferred, furthermore, to embody the lamp as a high-pressure discharge lamp. The cold pressure in the vessel is preferably at least 1 bar, with particular preference at least 10 bar. High radiant powers can be attained in this way in conjunction with short electrode spacings.

It is preferred, furthermore, to embody the lamp as a high intensity lamp. Such a lamp can be provided for an electrical power consumption of 250 W or more. Such lamps are particularly suitable for a projection unit, in particular for a cinema projector or similar units for projection, or for illumination units.

Another aspect of the present invention is directed to a method for the production of a lamp device having a contact conductor and a vessel that delimits a primary volume and a secondary volume comprises the following steps according to the invention:

firstly, a first component body for forming the primary volume, and a second component body for forming the secondary volume are provided. Furthermore, the contact conductor, which has a recess, is provided. The contact conductor is partially introduced into the first component body. The vessel is formed by means of connecting the first component body and the second component body. Here, the first component body and the second component body are interconnected, preferably after the partial insertion of the contact conductor into the first component body, the primary volume and the secondary volume being interconnected by a transitional region, and the recess in the contact conductor being arranged in the transitional region. The lamp device is subsequently completed.

The connection of the first component body to the second component body is preferably produced by means of fusing the component bodies together. The transitional region thus formed is preferably directly formed integrally on the contact conductor. In this case, the interior of the vessel in the transitional region is free from a spacing element that is provided for setting a prescribed spacing between the contact conductor and the vessel. It is thus advantageously possible, in the transitional region of the vessel, to dispense with additional elements that do not serve to make contact with the electrode.

The recess in the contact conductor is in this case preferably dimensioned in such a way that the material of the component bodies, which is flowable during the fusing together, does not penetrate, or does so only slightly, into the recess for the purpose of forming the vessel during the fusing together. The recess is therefore not completely filled up by the material. The inner cross section, free from the contact conductor, of the vessel in the transitional region can thus advantageously be enlarged.

After the cooling down of the component bodies and of the contact conductor, it is possible that on the basis of different coefficients of thermal expansion of the material for the contact conductor, on the one hand, and the material for the component bodies for forming the vessel, on the other hand a gap-like interspace forms, at least in some portions, between the transitional region of the vessel and the contact conductor.

In a preferred refinement, an ambient gas enclosed in the vessel is pumped out. It is preferred to pump out via a passage region that is formed in the vessel.

During pumping out, at least a portion of the ambient gas flows through the recess. The ambient gas can therefore flow through the gap-like interspace between the vessel and the contact conductor in the transitional region and, in addition, through the recess, for example from the secondary volume into the primary volume. Consequently, the recess can be used to simplify the pumping out of the ambient gas from the vessel, as a result of which a residual pressure, remaining in the vessel, of the ambient gas can advantageously be reduced. A discoloration or blackening of the vessel caused by the ambient gas during operation of the lamp device can advantageously be reduced.

In a further preferred refinement, the vessel, preferably after the pumping out of the ambient gas, is filled with a useful gas that particularly preferably contains a noble gas, for example xenon. The filling can be performed via the passage region.

In a further preferred refinement, the recess in the contact conductor is formed by local removal of the contact conductor material. This can be performed, for example, by means of laser radiation. Alternatively or in addition, the recess can be produced mechanically, for example by means of sawing or milling.

DETAILED DESCRIPTION OF THE DRAWINGS

Figure 1:
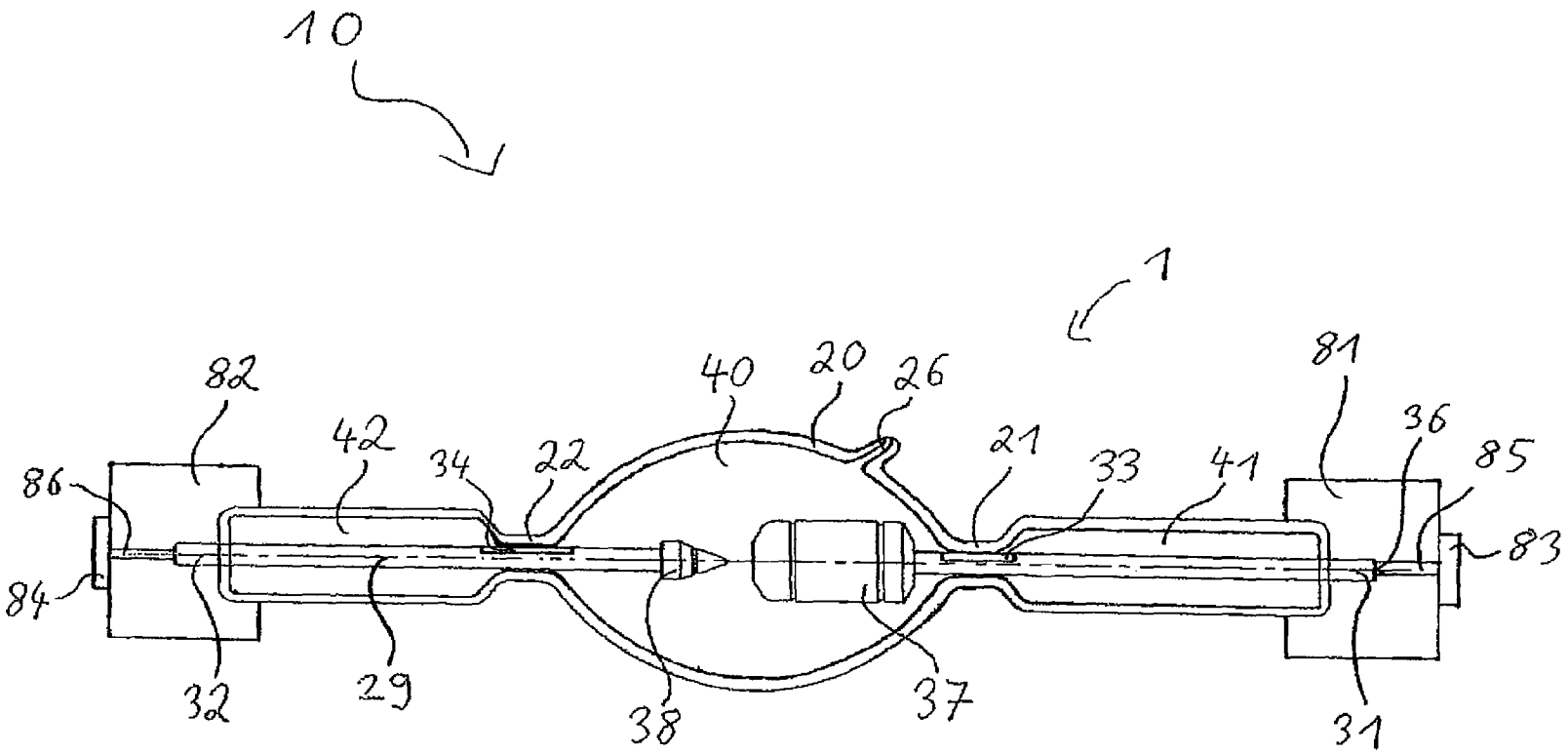
FIG. 1 shows an exemplary embodiment of a lamp having an inventive lamp device, in a schematic sectional view.

Identical, similar and identically acting elements are provided with the same reference numerals in the figures.

FIG. 1 shows an exemplary embodiment of a gas discharge lamp 10 having an inventive lamp device 1, in sectional view. The lamp device 1 has a vessel 20. The vessel delimits a primary volume 40 and a secondary volume 41 as well as a further secondary volume 42. The secondary volume 41 and the further secondary volume 42 are formed on mutually opposite sides of the primary volume.

The primary volume and the secondary volume are interconnected by a transitional region 21 of the vessel 20. Furthermore, the further secondary volume 42 and the primary volume are interconnected by means of a further transitional region 22 of the vessel 20.

The lamp device comprises a contact conductor 31, which extends from the primary volume 40 through the transitional region 21 into the secondary volume 41. An electrode 37 is formed on the contact conductor 31. This electrode is arranged in the primary volume of the vessel. The contact conductor projects from the vessel on a side of the contact conductor that is averted from the electrode. An end face 36 bounding the contact conductor on the side averted from the electrode is therefore accessible from outside the vessel.

The contact conductor 31 is of elongated design. For example, the contact conductor can be of rod-shaped design, for example with a substantially circular cross section. Furthermore, the contact conductor 31 has a recess 33 that is arranged in the transitional region 21 of the vessel. The recess extends along the longitudinal direction of the contact conductor, starting from the primary volume 40 as far as into the secondary volume 41.

The electrode 37 projects beyond the contact conductor 31 transverse to the longitudinal direction of the contact conductor. By way of example, the electrode can have a basic shape like a cylinder or cuboid. The electrode 37 projects transverse to the contact conductor in a fashion so far beyond the latter that the electrode cannot be guided through the transitional region of the vessel 21 because of its lateral extent. Furthermore, in relation to the contact conductor 31 the electrode 37 projects so far beyond the latter that the electrode cannot be guided through the secondary volume 41. In the region of the secondary volume 41, the vessel 20 can thus have a smaller extent transverse to the longitudinal direction of the contact conductor 31 than the electrode 37.

Furthermore, the vessel 20 has a passage region 26. The passage region is formed, for example, in the region of the vessel 20 that delimits the primary volume. Contrary thereto, the passage region can also be formed in the region of the vessel that delimits the secondary volume. An exchange of gas can be performed via the passage region 26 during the production of the lamp device. For example, an ambient gas enclosed in the vessel can be pumped out via the passage region and, in particular subsequently, the vessel can be filled with a useful gas. The useful gas can contain a gas, preferably a noble gas, for example xenon, neon or argon. Furthermore, the useful gas can contain an additional filler, in particular for setting the color locus of the radiation generated during operation of the lamp 10, for example a metal halide.

Once the lamp device is completed, the passage region 26 is sealed such that the vessel 20 is gastight, and the useful gas enclosed in the vessel remains therein.

The recess 33 in the contact conductor is designed in such a way that an inner cross-sectional surface area, free from the contact conductor 31, of the transitional region 21 is increased by at least 5%, preferably by at least 10%, for example by between 20% and 30% inclusive, perpendicular to the longitudinal direction of the contact conductor by comparison with a corresponding arrangement without recess. This simplifies an exchange of gas between the primary volume 40 and the secondary volume 41. A lamp device in the case of which the ambient air enclosed during production can be removed from the vessel 20, particularly from the secondary volume, in an improved manner can thereby be produced in a simplified fashion. It follows that it is advantageously possible to avoid an impairment of the function of the lamp device during operation owing to a blackening of the inner surfaces of the vessel 20.

The recess, shown in FIG. 1, in the contact conductor is locally delimited in a longitudinal direction of the contact conductor. The recess is thus spaced apart both from the electrode 37 on one side, and from the end face 36 of the contact conductor, on the other side.

The recess 33 is designed like a trough, for example. Such a recess is described in more detail in conjunction with FIGS. 2A and 2B. Further exemplary embodiments of the recess in the contact conductor are explained in conjunction with FIGS. 3A and 3B as well as FIGS. 4A and 4B.

Alternatively, the recess 33 can also be of fluted design, the recess being capable, by way of example, of extending continuously from the electrode up to the end face 36 of the contact conductor 31 (not illustrated).

The vessel 20 is expediently fabricated by means of a material that is transmissive at least for spectral sub-ranges of the radiation generated in the vessel 20 during operation of the lamp device 1. Glass, for instance quartz glass, is suitable as material, by way of example.

The contact conductor 31 and the electrode 37 are of multipartite design, the contact conductor and the electrode being interconnected in an electrically conducting fashion and being in mechanical contact with one another. Alternatively, however, the contact conductor can also be designed in one piece with the electrode. The contact conductor 31 and the electrode 37 are preferably designed in an electrically conducting fashion, with particular preference in metallic fashion. In particular, the contact conductor and the electrode can contain a metal or consist of a metal or a metal alloy. Particularly preferred metals for electrodes of a gas discharge lamp are molybdenum and tungsten.

Furthermore, the lamp device 1 has a further contact conductor 32 and a further electrode 38. Here, there is formed in the further electrode 32 a further recess 34 that is arranged in the further transitional region 22. The further contact conductor 32 and the further recess 34 can be designed substantially like the contact conductor 31 and like the recess 33, respectively.

The longitudinal direction of the contact conductor 31 and the longitudinal direction of the contact conductor 32 run collinearly. This is indicated in FIG. 1 with the aid of a line 29 that runs centrally through the contact conductor and the further contact conductor.

As distinguished from the electrode 37, which is designed as an anode, the further electrode 38 is designed as a cathode. The further electrode 38 tapers toward the electrode 37. In operation of the lamp device, a gas discharge can take place between the electrode 37 and the further electrode 38, which are spaced apart from one another. A stable gas discharge can be attained in a simplified fashion by means of the tapering shape of the further electrode 38. Contrary to the exemplary embodiment shown, the electrode 37 and the further electrode 38 can, however, also be of a similar design if appropriate.

The lamp device 1 has, merely by way of example, two secondary volumes 41, 42, a contact conductor respectively extending through the transitional region that respectively adjoins the secondary volume. Of course, the invention is also suitable for lamp devices having only one secondary volume or having more than two secondary volumes. Furthermore, it is also possible for more than one contact conductor, in particular two contact conductors, to run through a common secondary volume.

The lamp 10 has a base part 81 and a further base part 82. The base part 81 and the base part 82 adjoin the vessel 20 on opposite sides thereof. Formed on the base part 81 is a terminal 83 that is connected to the contact conductor 31 in an electrically conducting fashion via a connecting conductor 85. Correspondingly formed on the further base part 82 is a further terminal 84, which is connected to the further contact conductor 31 in an electrically conducting fashion via a further connecting conductor 86. The base parts are provided for fastening the lamp 10 in a mount.

The terminal 83 and the further, terminal 84 are preferably of metallic design. During operation of the lamp 10, an external voltage can be applied to the lamp by means of the terminals, the electrodes 37 and 38 respectively being energized via the connecting conductors 85 and 86, respectively, and the contact conductors 31 and 32, respectively.

The connecting conductor 85 and the further connecting conductor 86 can be designed, for example, as a metallic wire or as a metallic wire assembly.

The lamp 10 is designed as a discharge lamp, in particular as a high-pressure discharge lamp. Here, the primary volume 40 constitutes the discharge space in which an arc forms between the electrode 37, the anode, and the further electrode 38, the cathode, during operation of the lamp. For example, the lamp can be designed as a xenon discharge lamp. Such a lamp can be used, for example, in a projector, in particular in a cinema projector or in a comparable unit for projection, or in a unit for illumination.

Lamps of such type are particularly suitable for high electrical power consumptions of 250 W or more.

Figure 2A:
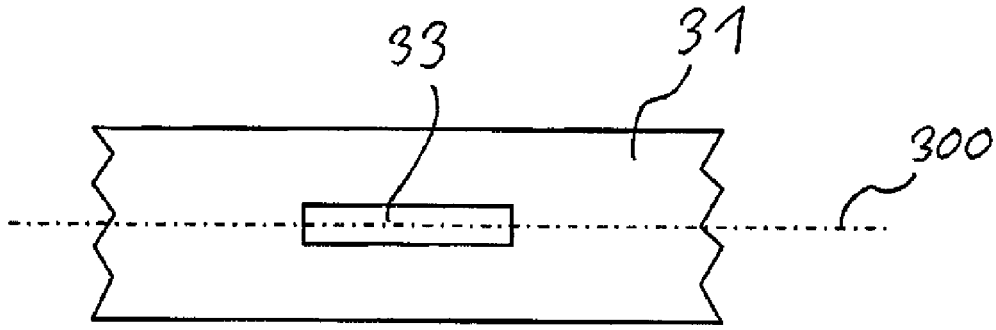
FIGS. 2A and 2B show a first exemplary embodiment of a contact conductor of an inventive lamp device with the aid of a segment of the contact conductor, in a schematic plan view in FIG. 2A and in a schematic sectional view in FIG. 2B, FIGS. 3A and 3B show a second exemplary embodiment of a contact conductor of an inventive lamp device with the aid of a segment of the contact conductor, in a schematic plan view in FIG. 3A and in a schematic sectional view in FIG. 3B, FIGS. 4A and 45 show a third exemplary embodiment of a contact conductor of an inventive lamp device with the aid of a segment of the contact conductor, in a schematic plan view in FIG. 4A and in a schematic sectional view in FIG. 4E, FIGS. 5A to 5C show an exemplary embodiment of an inventive method with the aid of intermediate steps illustrated schematically in sectional view.
Figure 2B:
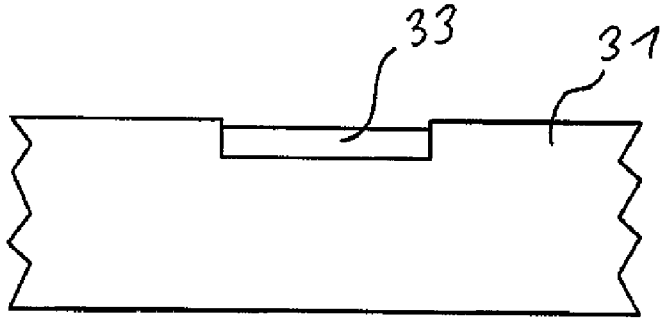

FIG. 2A illustrates a first exemplary embodiment of a contact conductor of an inventive lamp device with the aid of a segment in plan view. FIG. 2B shows a sectional view along the line 300 shown in FIG. 2A. The contact conductor 31 is designed like a rod and has a circular cross section. In a variation therefrom the cross section of the contact conductor can, for example, also have an elliptical or polygonal, for example rectangular, shape.

Furthermore, the contact conductor 31 has a recess 33. This recess is locally bounded in a longitudinal direction of the contact conductor. The recess 33 is designed like a trough. The recess therefore does not extend completely through the contact conductor in a direction transverse to the longitudinal direction of the contact conductor. Here, by way of example, the recess has a cuboidal basic shape on the side facing the contact conductor.

The recess preferably has a width and/or a depth of between 10 μm inclusive and 20 mm inclusive, with particular preference of between 50 μm inclusive and 5 mm inclusive.

Figure 3A:
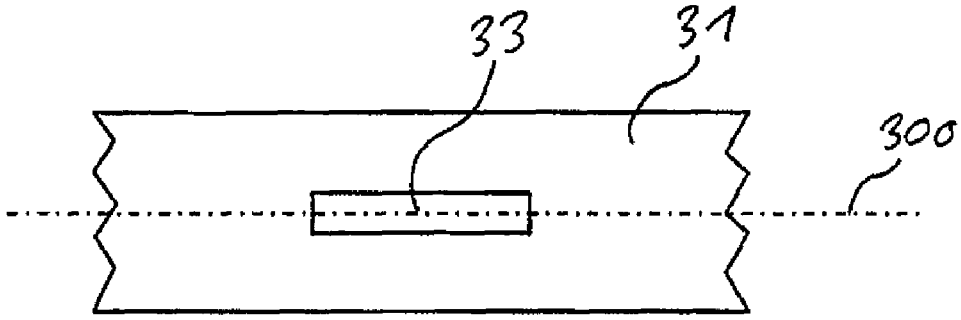
Figure 3B:
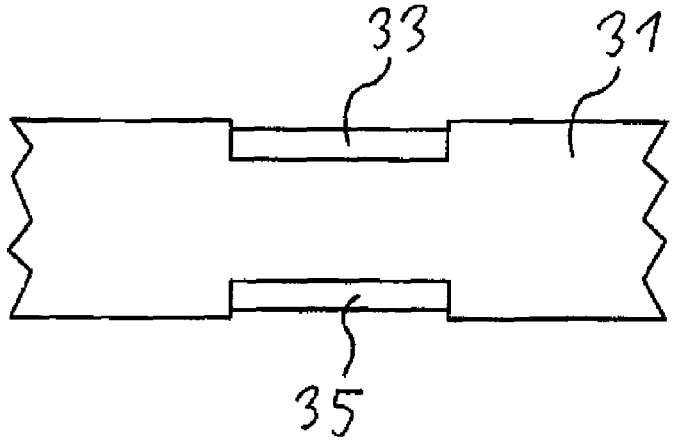

A second exemplary embodiment of a contact conductor 31 is shown with the aid of FIGS. 3A and 3B. The contact conductor 31 in accordance with the second exemplary embodiment differs from the first exemplary embodiment in accordance with FIG. 2A essentially in that the contact conductor has an additional recess 35 in addition to the recess 33. The recess 33 and the additional recess 35 are arranged diametrically in relation to one another, merely by way of example.

Figure 4A:
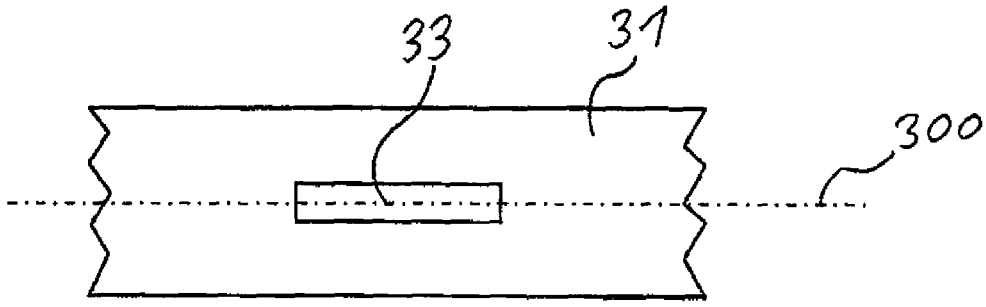
Figure 4B:
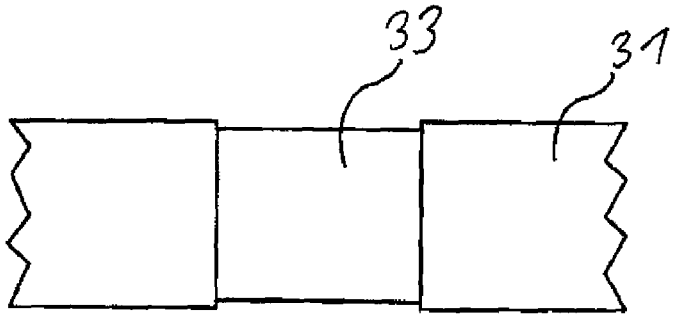

A third exemplary embodiment of a contact conductor 31 of an inventive lamp device is shown in FIGS. 4A and 4B. The third exemplary embodiment differs from the first exemplary embodiment in accordance with FIG. 2A in that the recess 33 extends completely through the contact conductor transverse to the longitudinal direction of the contact conductor 31. In case of such a slot-type design of the recess 33, a gas enclosed in the vessel can flow through the contact conductor 31.

The recess can also be designed in a fashion differing from the embodiments of the contact conductor that are described with the aid of FIGS. 2A to 4B, as long as the recess can be used to form in the lamp device a channel between the primary volume 40 and the secondary volume 41 through which the gas enclosed in the vessel can flow. Here, the channel can also be located in some portions in the interior of the contact conductor, that is to say in a fashion spaced apart from a surface bounding the contact conductor transverse to the longitudinal direction.

Figure 5A:
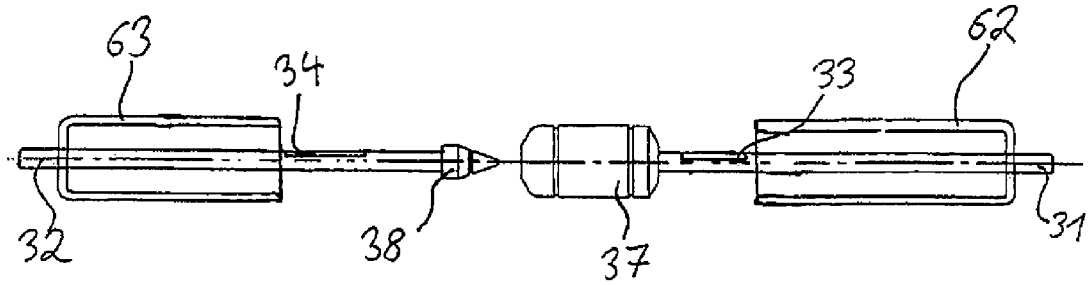
Figure 5B:
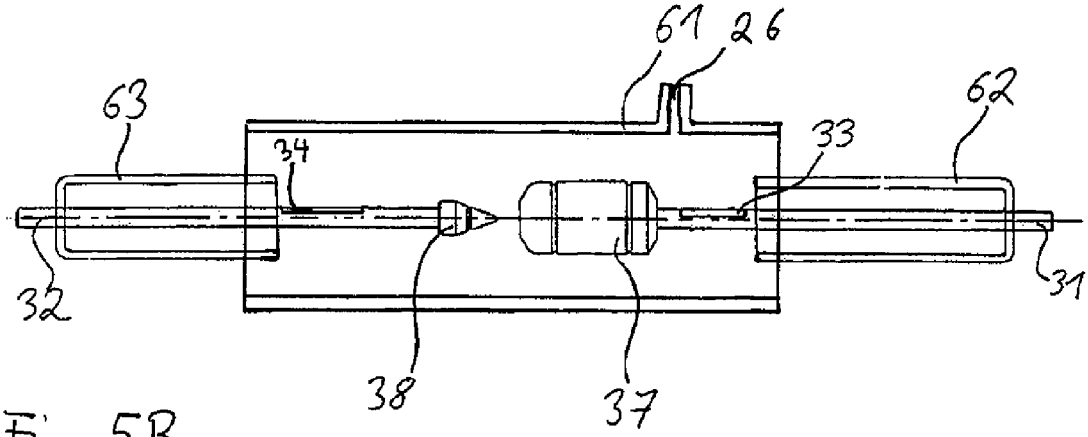
Figure 5C:
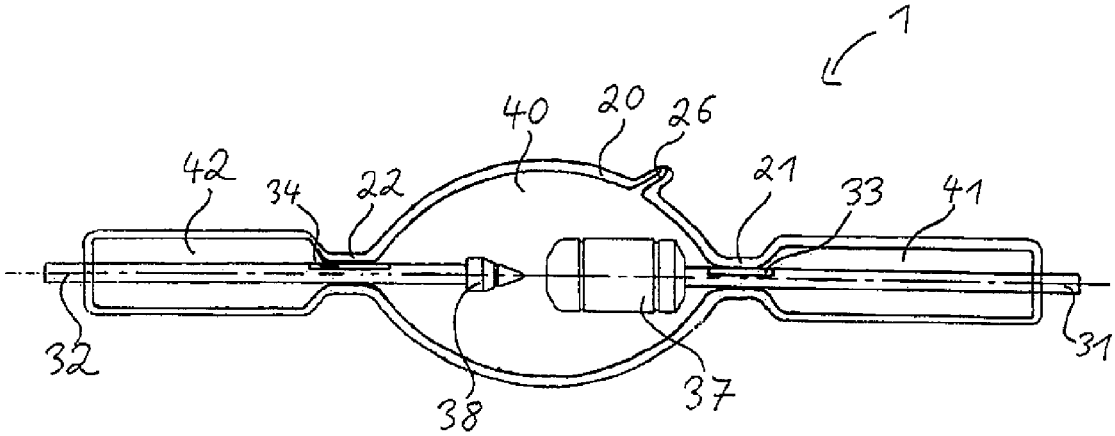

An exemplary embodiment of an inventive method for producing a lamp device is shown in FIGS. 5A to 5C with the aid of intermediate steps illustrated schematically in sectional view. Here, the method is shown by way of example for a lamp device that is designed as described in conjunction with FIG. 1.

A first component body 61, a second component body 62 and a third component body 63 are provided for forming the vessel 20 of the lamp device 1.

Also provided are a contact conductor 31 with a recess 33, and a further contact conductor 32 with a further recess 34. The recess can be formed, for example, by means of laser radiation, that is to say by means of local laser-induced removal of material of the contact conductor and of the further contact conductor, respectively.

Alternatively, or in addition, the recess 33 and/or the further recess 34 can be produced mechanically, for example by means of sawing or milling.

An electrode 37 and a further electrode 38 are respectively formed on the contact conductor 31 and on the further contact conductor 33.

As illustrated schematically in FIG. 5A, the contact conductor 31 and the further contact conductor 32 are introduced into the second component body 62 and into the third component body 63, respectively, and connected to the respective component body in a mechanically stable fashion. The connections are preferably designed in each case such that the component bodies continuously surround the respective contact conductor on the periphery and directly adjoin the respective contact conductor such that a gastight connection results between the contact conductor and the respective component body. An opening, for example, like a gap, between the contact conductor and the respective component body can thus advantageously be avoided. This can be performed, for example, by fusing the component bodies onto the assigned contact conductor.

As illustrated in FIG. 5B, the contact conductor 31 is thereupon partially introduced into the first component body 61. The electrode 37 is completely introduced into the first component body. The further contact conductor 32 is correspondingly partially introduced into the first component body 61, the further electrode 38 being completely introduced into the first component body.

After the introduction of the electrode 37 into the first component body 61, the latter is connected to the second component body 62 in a mechanically stable fashion. This can be performed by fusing these component bodies together. As can said seen in FIG. 5C, a transitional region 21 is formed in this case. During this step the material of the first component body and of the second component body is integrally formed on the contact conductor 31 in a heated-up and therefore flowable state. The contact conductor is also heated up here and expands as a consequence of being heated up.

Thus, the transitional region 21 is formed after the introduction of the electrode 37 into the first component body 61. There is thus no need to be able to guide the electrode through the transitional region. The electrode can therefore have a lan arger cross section than the vessel in the transitional region. An electrode with a comparatively large cross section can therefore advantageously be used, the result being to simplify the production of a lamp device for a lamp of high radiant power, for example from 250 W.

Furthermore, the cross section of the electrode can be larger than the inner cross section of the second component body 62, since the electrode need not be guided through the second component body during production. Thus, given an enlargement of the electrode, the inner cross section of the second component body 62 can be maintained. Even in the case of an enlargement of the cross section of the electrode that is required to increase the radiant power during operation of the lamp device, if appropriate, it is advantageously possible to use the same base parts when use is made of the lamp device 1 in a lamp 10 as described in conjunction with FIG. 1. Thus, the same mount can also be used for mounting the appropriately modified lamp.

The recess 33 is arranged in the transitional region 21. The recess is expediently designed in such a way that the material of the first component body and of the second component body does not completely fill this recess in the heated up state because of its viscosity. The recess 33 thus remains at least partially free from this material.

Once the first component body 61 and the second component body 62 have been fused together, the vessel is actively or passively cooled down, the volume of the contact conductor 31 reverting to the state before being heated up. Thus, a gap-like interspace is formed at least in portions between the contact conductor 31 and the vessel 20 in the transitional region 22. This interspace is comparatively small and therefore not explicitly visible in FIG. 5C. The primary volume 40 and the secondary volume 41 are interconnected via this interspace and via a channel formed by means of the recess.

It is advantageously possible to dispense with an additional element that is arranged between the contact conductor 31 and the vessel 20 in the transitional region 21 and serves to space the contact conductor apart from the vessel.

The first component body 61 can be joined together with the third component body 63 in a way substantially similar to the joining together of the first component body 61 with the second component body 62. Here, a further transitional region 22 is formed, via which the further secondary volume 42 and the primary volume 40 are interconnected.

The vessel 20 thus produced is subsequently evacuated via the passage region 26. Here, ambient air located in the secondary volumes 41 and 42 can flow through the recess 33 in the contact conductor 31 and through the further recess 34 in the further contact conductor 32. Owing to these additional channels respectively formed by the recesses, the ambient gas enclosed in the vessel, in particular the gas in the secondary volumes, can be more effectively pumped out. A residual quantity of ambient gas remaining in the vessel 20 can thus be reduced.

After being pumped out, the vessel 20 can be filled via the passage region 26 with a useful gas at a defined cold fill pressure, preferably 1 bar or more. For the completion of the lamp device 1, the passage region is sealed. This can be performed, for example, by melting the vessel locally in the passage region.

Of course, the method described with the aid of the exemplary embodiment is also suitable for producing a lamp device whose vessel has only one secondary volume or more than two secondary volumes.

Figure 6A:
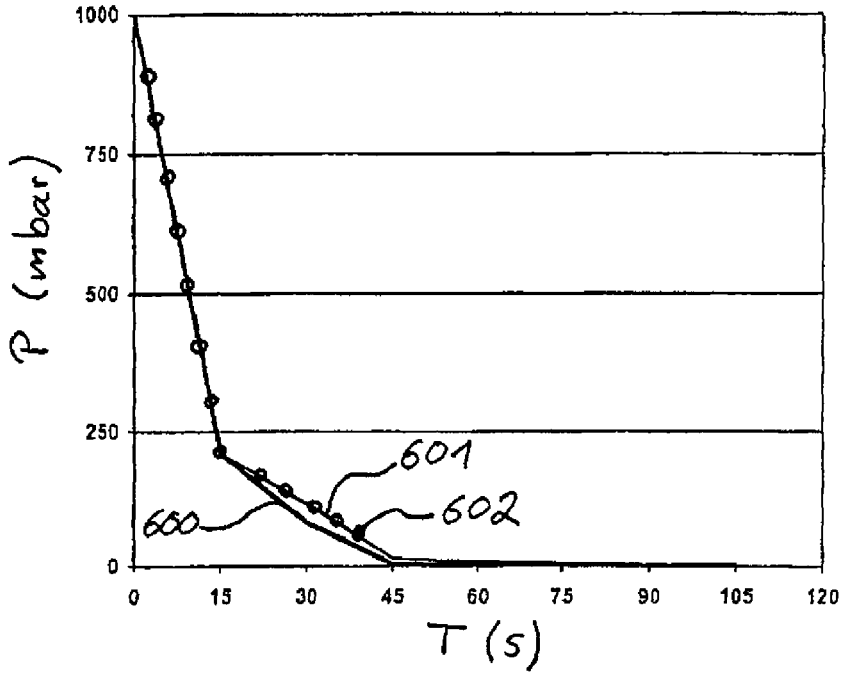
FIGS. 6A and 6B show results of measurements of the pressure P in a vessel of two inventive lamp devices by comparison with a conventional lamp device, as a function of time T, FIG. 6B representing a segment of FIG. 6A.
Figure 6B:
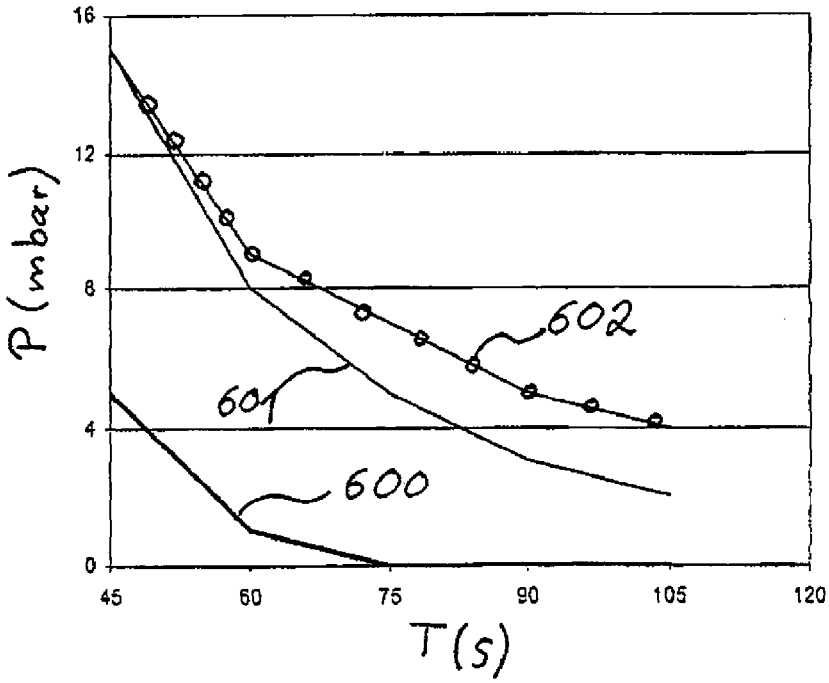

FIGS. 6A and 6B show the result of measurements of the pressure P as a function of time T for three different lamp devices. Here, a segment from FIG. 6A is illustrated in an enlarged fashion in FIG. 6B.

A curve 600 shows the result of a measurement on a first inventive lamp device that is designed as described in conjunction with FIG. 1. The width of the recess designed like a trough is 1 mm in the case of the first lamp device and the depth of the recess is 0.3 mm. A curve 601 shows a measurement on a further inventive lamp device, the depth of the recess being reduced approximately by a factor of 2 by comparison with the first lamp device. A curve 602 shows the result of a comparative measurement on a conventional lamp device in the case of which the contact conductor has no recess in the transitional region. The measurement results show that in the case of a conventional lamp device the pressure drops more slowly than in the case of the inventive first and second lamp devices. By way of example, in the case of a pump duration of 75 seconds the pressure is, for example, still approximately 7 mbar in a conventional lamp device, approximately 5 mbar in the case of the second lamp device and substantially less than 0.5 mbar in the case of the first lamp device. Furthermore, the measurements show that the vessel of the lamp device can be pumped out more effectively through a recess of deeper design, that is to say through an enlargement of the cross section of the recess.

The invention is not limited by the description on the basis of the exemplary embodiments. Rather, the invention comprises any new feature as well as any combination of features, and this includes, in particular, any combination of features in the patent claims even if this feature or this combination is not itself explicitly specified in the patent claims or the exemplary embodiments.

The invention claimed is:

1. A lamp device, comprising:

at least one contact conductor; and a vessel for enclosing a gas;

wherein the vessel delimits a primary volume and a secondary volume, the primary volume and the secondary volume are interconnected by a transitional region of the vessel, the at least one contact conductor extends through the transitional region and the secondary volume, and wherein the at least one contact conductor has a recess arranged in the transitional region.

2. The lamp device as claimed in claim 1, wherein the recess in the at least one contact conductor extends from the primary volume into the secondary volume.

3. The lamp device as claimed in claim 1, wherein the recess is a channel for transfer of the gas from the primary volume into the secondary volume and for transfer of the gas from the secondary volume into the primary volume.

4. The lamp device as claimed in claim 1, wherein an electrode is formed on the at least one contact conductor and the electrode is arranged in the primary volume of the vessel.

5. The lamp device as claimed in claim 4, wherein the at least one contact conductor is elongated, and the electrode projects beyond the at least one contact conductor transversely to a longitudinal direction of the at least one contact conductor.

6. The lamp device as claimed in claim 5, wherein an extent of an electrode perpendicular to the longitudinal direction of the at least one contact conductor is greater than a minimum inside diameter of the transitional region of the vessel.

7. The lamp device as claimed in claim 1, wherein the at least one contact conductor is elongated.

8. The lamp device as claimed in claim 7, wherein, starting from the transitional region, the vessel widens along a longitudinal direction of the at least one contact conductor toward the primary volume of the vessel and toward the secondary volume of the vessel.

9. The lamp device as claimed in claim 7, wherein the recess is configured such that, perpendicular to a longitudinal direction of the at least one contact conductor, an inner cross-sectional surface area, free from the at least one contact conductor, of the transitional region is increased by at least 5%.

10. The lamp device as claimed in claim 9, wherein the inner cross-sectional surface area, free from the at least one contact conductor, of the transitional region is increased by at least 10%.

11. The lamp device as claimed in claim 7, wherein the recess completely penetrates the at least one contact conductor transversely to a longitudinal direction.

12. The lamp device as claimed in claim 1, wherein the recess is a trough.

13. The lamp device as claimed in claim 1, wherein the at least one contact conductor has an additional recess in the transitional region of the vessel.

14. A lamp comprising a lamp device as claimed in claim 1.

15. The lamp as claimed in claim 14, wherein the lamp is provided for an electrical power consumption of 250 W or more.

16. The lamp as claimed in claim 14, wherein the lamp is a discharge lamp.

17. The lamp as claimed in claim 14, wherein the lamp is-a high-pressure discharge lamp.

18. A method for the production of a lamp device having a contact conductor and a vessel that delimits a primary volume and a secondary volume, comprising the steps of:

providing a first component body for forming the primary volume, and a second component body for forming the secondary volume;

providing the contact conductor, which has a recess;

partially introducing the contact conductor into the first component body;

forming the vessel by connecting the first component body to the second component body, the primary volume and the secondary volume being interconnected by a transitional region, and the recess in the contact conductor being arranged in the transitional region and the contact conductor extending through the secondary volume; and completing the lamp device.

19. The method as claimed in claim 18, wherein the connection of the first component body to the second component body is produced by fusing the component bodies together.

20. The method as claimed in claim 19, wherein the vessel has a passage region through which an ambient gas enclosed in the vessel is pumped out.

21. The method as claimed in claim 20, wherein, after being pumped out, the vessel filled with a useful gas.

22. The method as claimed in claim 20, wherein, while being pumped out, ambient gas flows at least partially through the recess in the contact conductor.

23. The method as claimed in claim 18, wherein the recess in the contact conductor is produced by laser radiation.

24. The method as claimed in claim 18, wherein the recess in the contact conductor is produced by sawing or milling.

* * * * *